US008584913B1

(12) United States Patent
Perlsweig

(10) Patent No.: US 8,584,913 B1
(45) Date of Patent: Nov. 19, 2013

(54) METHOD FOR RECONNECTING A BUTTON TO A GARMENT AND APPARATUS THEREFOR

(76) Inventor: Leon Perlsweig, Woodland Hills, CA (US)

( * ) Notice: Subject to any disclaimer, the term of this patent is extended or adjusted under 35 U.S.C. 154(b) by 0 days.

(21) Appl. No.: 13/534,869

(22) Filed: Aug. 16, 2012

(51) Int. Cl.
*A41H 37/10* (2006.01)
*D05B 3/14* (2006.01)
*A44B 1/20* (2006.01)

(52) U.S. Cl.
USPC ..... 223/44; 24/114.7; 2/265

(58) Field of Classification Search
USPC ..... 2/265; 24/40, 94–96, 114.7; 223/44
See application file for complete search history.

(56) References Cited

U.S. PATENT DOCUMENTS

| | | | | | |
|---|---|---|---|---|---|
| 818,983 | A | * | 4/1906 | Smith | 24/114.1 |
| 1,343,289 | A | * | 6/1920 | Suchy | 227/68 |
| 2,425,031 | A | * | 8/1947 | De Wald | 72/125 |
| 2,804,668 | A | * | 9/1957 | Rubenstein | 24/103 |
| 2,935,434 | A | * | 5/1960 | Dawson | 264/248 |
| 3,142,878 | A | * | 8/1964 | Santora | 24/96 |
| 3,349,447 | A | | 10/1967 | Raleigh | |
| 3,596,329 | A | | 8/1971 | Hoban | |
| 3,754,304 | A | | 8/1973 | Modrey | |
| 3,787,935 | A | * | 1/1974 | Kapitan | 24/113 MP |
| 3,795,948 | A | | 3/1974 | Kapitan | |
| 3,900,925 | A | * | 8/1975 | La Torraca | 24/90.1 |
| 4,097,969 | A | * | 7/1978 | Nysten | 24/114.7 |
| 4,333,182 | A | | 6/1982 | Seibt | |
| 4,521,943 | A | * | 6/1985 | Kanzaka | 24/689 |
| 4,773,343 | A | | 9/1988 | Riche | |
| 5,671,507 | A | | 9/1997 | Deschenes | |
| 6,702,162 | B1 | | 3/2004 | Hassid | |

* cited by examiner

*Primary Examiner* — Ismael Izaguirre
(74) *Attorney, Agent, or Firm* — Timothy Thut Tyson; Ted Masters; Leon D. Rosen & Associates, P.C.

(57) ABSTRACT

A method and apparatus for reconnecting a button to a garment includes positioning the button in a desired location on the front side of garment. The ends of a wire are then manually inserted into the thread receiving holes of the button, and the wire is pushed through the garment from the front side to the back side so that the wire urges the button into contact with the first side of the garment, and the ends of the wire penetrate the back side of the garment thereby forming first and second protruding legs. The protruding legs are then manually bent over until they abut the back side of the garment. A sheet is then adhesively applied to the back side of the garment to cover the bent over protruding legs. In another embodiment, the protruding legs are twisted together before being bent over.

20 Claims, 7 Drawing Sheets

METHOD FOR RECONNECTING A BUTTON TO A GARMENT AND APPARATUS THEREFOR

TECHNICAL FIELD

The present invention pertains generally to garments having buttons, and more particularly to a method and apparatus for reconnecting a button to a garment.

BACKGROUND OF THE INVENTION

Buttons are commonly used as a closure for garments. The buttons have holes that receive thread that is used to sew the buttons onto the garment. If the thread becomes loose, the button will not function properly. Moreover, if the thread breaks, the button can fall off the garment and get lost. In such instances, the common remedy is to re-sew the button onto the garment. However, a needle and thread are usually not immediately available to effect the reconnection. A method and apparatus for reconnecting a button to a garment before it falls off and gets lost would be helpful.

BRIEF SUMMARY OF THE INVENTION

The present invention is directed to a method and apparatus for reconnecting a button to a garment. The method and apparatus permit either a loose button or a disconnected button to be reconnected without the use of sewing materials. The method includes positioning the loose or disconnected button in a desired location on the front side of garment. The ends of a wire are then manually inserted into the thread receiving holes of the button, and the wire is pushed through the garment from the front side to the back side so that the wire urges the button into contact with the first side of the garment, and the ends of the wire penetrate the back side of the garment thereby forming first and second protruding legs. The protruding legs are then manually bent over until they abut the back side of the garment.

In another embodiment, a sheet is adhesively applied to the back side of the garment to cover the bent over protruding legs.

In another embodiment, the protruding legs are twisted together before being bent over.

Other embodiments, in addition to the embodiments enumerated above, will become apparent from the following detailed description, taken in conjunction with the accompanying drawings, that illustrate, by way of example, the principles of the method and apparatus.

DETAILED DESCRIPTION OF THE INVENTION

Figure 1:
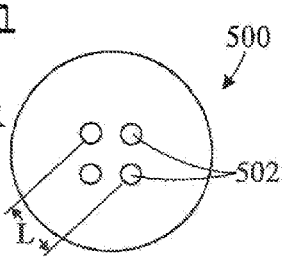
Fig. 1 PRIOR ART
FIG. 1 is a front elevation view of a prior art button.
Figure 2:
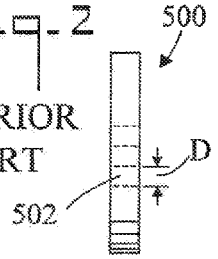
Fig. 2 PRIOR ART
FIG. 2 is a side elevation view of the prior art button.

Referring initially to FIGS. 1 and 2, there are illustrated front elevation and side elevation views, respectively, of a prior art button, generally designated as 500. Button 500 has a plurality of thread receiving holes 502 having a diameter D. In the shown embodiment, button 500 has four thread receiving holes 502, each of that have the same diameter D. It may be appreciated that button 500 could have another number of thread receiving holes 502 such as two, three, five, etc. It is further noted that two of the thread receiving holes 502 are spaced apart a distance L. As shown L is between two diagonally opposite holes 502, but could also be a lesser distance between two adjacent holes 502.

Figure 3:
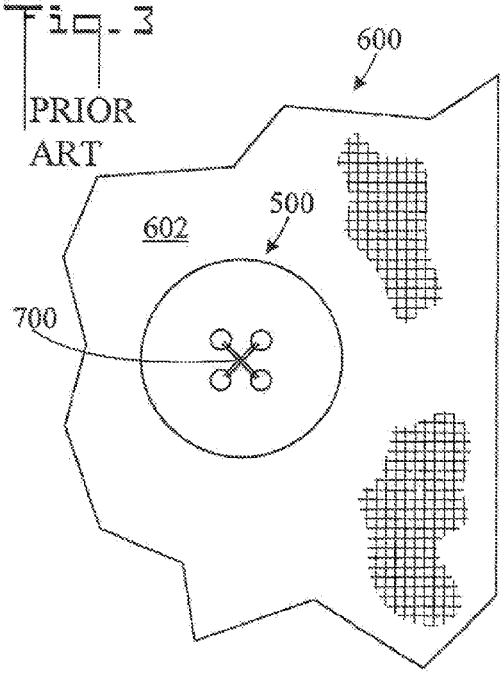
Fig. 3 PRIOR ART
FIG. 3 is a fragmented front elevation view of the prior art button connected to a garment.
Figure 4:
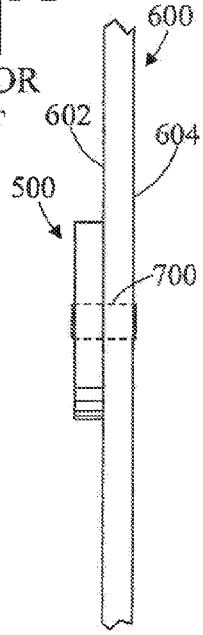
Fig. 4 PRIOR ART
FIG. 4 is a fragmented side elevation view of the prior art button connected to the ent.

FIGS. 3 and 4 are fragmented front elevation and side elevation views, respectively, of button 500 connected to a garment 600 that is typically made from fabric such as the front of a shirt. Garment 600 has a front side 602 and an opposite back side 604 (also refer to FIG. 14). Button 500 is connected to garment 600 with thread 700 in the conventional manner. It is noted that in FIG. 4, the dashed lines representing hole 502 have been omitted for clarity.

Figure 5:
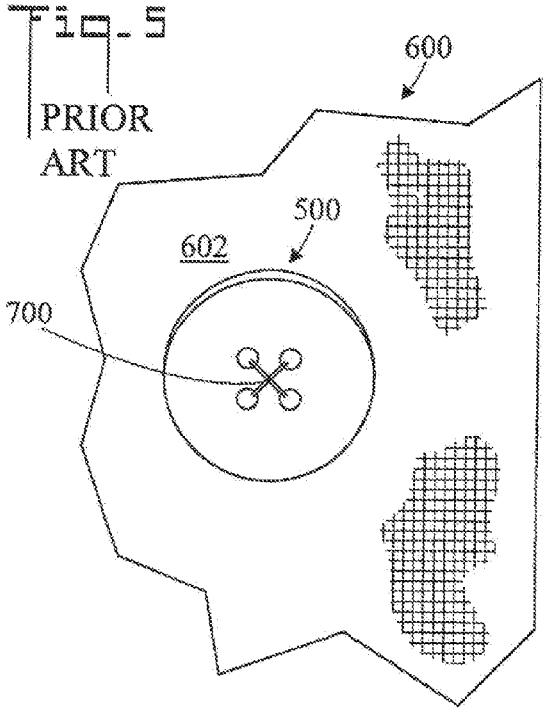
Fig. 5 PRIOR ART
FIG. 5 is a fragmented front elevation view of the prior art button that has come loose from the front side of the garment.
Figure 6:
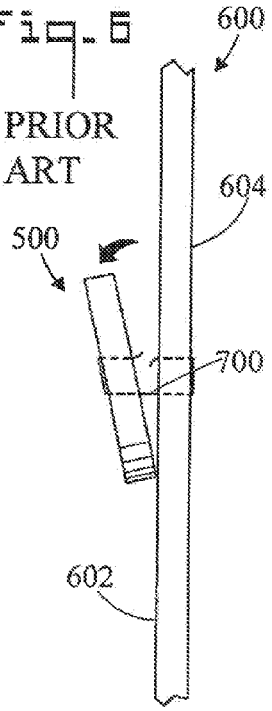
Fig. 6 PRIOR ART
FIG. 6 is a fragmented side elevation view of the loose prior art button.

FIGS. 5 and 6 are fragmented front and side elevation views, respectively, of button 500 that has come loose from front side 602 of garment 600. Thread 700 has loosened with the result that button 500 is no longer firmly connected to garment 600, but rather hangs loosely from front side 602. As used herein, the term "come loose" either means loosely connected as in FIGS. 5 and 6, or completely disconnected.

Figure 7:
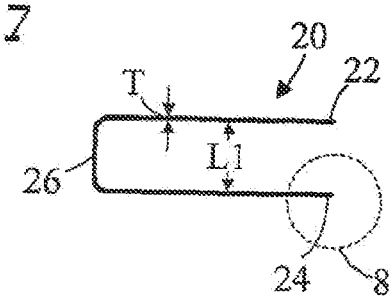
FIG. 7 is a side elevation view of a wire that is used to reconnect a button to a garment.

FIG. 7 is a side elevation view of a wire 20 that is used to reconnect button 500 to garment 600 (refer also to FIGS. 5 and 6). Wire 20 has a first end 22, a second end 24, and a wire thickness T that is less than diameter D of thread receiving holes 502 of button 500 (refer also to FIGS. 1 and 2). For circular wire 20, thickness T is the diameter of the wire 20. For other cross sectional shapes, thickness T is the maximum cross sectional dimension of the wire. In either case, wire thickness T permits wire 20 to be passed through holes 502. Further, wire 20 has a stiffness (engineering designation k) that both (1) permits wire 20 to be manually pushed with the ends first through garment 600 from front side 602 to back side 604 (refer also to FIG. 11), and (2) permits wire 20 to be manually bent over so that it abuts back side 604 of garment 600 (refer also to FIGS. 13 and 20). In other words, wire 20 is sufficiently rigid to be pushed through the fabric of garment 600 without bending, and also flexible enough to be bent over once it has passed through garment 600.

To facilitate passage through garment 600 in the shown embodiment, wire 20 is preformed into an elongated U-shape that has two elongated substantially parallel segments connected by a perpendicular cross member 26. The segments are spaced apart a distance L1 that is substantially equal to the spaced apart distance L of the two thread receiving holes 502 of button 500 (refer to FIG. 1). In an embodiment, wire 20 is fabricated from aluminum. However, it may be appreciated that wire 20 could be fabricated from another metal, or even a polymer so long as it has the required stiffness properties. It may also be appreciated that a non-preformed wire 20 could be used to connect button 500 to garment 600.

Figure 8:
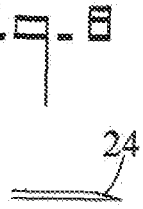
FIG. 8 is an enlarged view of area 8 of FIG. 7.

FIG. 8 is an enlarged view of area 8 of FIG. 7. In an embodiment, first 22 and second 24 ends of wire 20 are sharpened to facilitate passage through garment 600.

Figure 9:
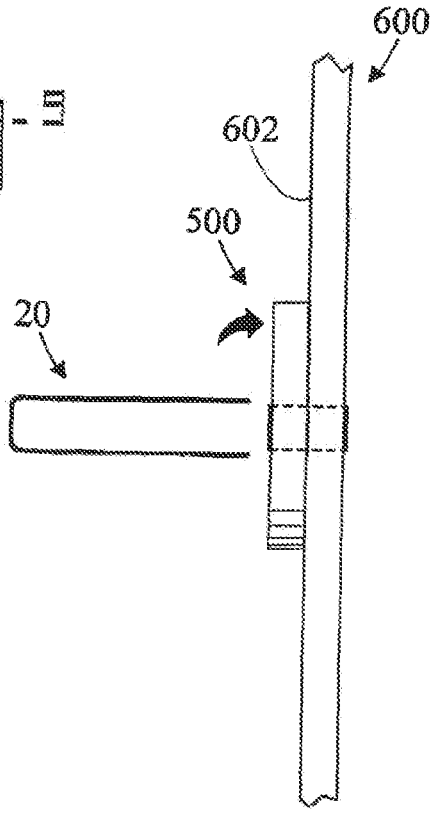
FIG. 9 is a fragmented side elevation view of the wire positioned to be pushed through the button and garment.

FIG. 9 is a fragmented side elevation view of wire 20 positioned prior to being pushed through button 500 and garment 600. Prior to positioning wire 20, button 500 is positioned in a desired location on front side 602 of garment 600. As shown, the loose button 500 of FIGS. 5 and 6 has been rotated to its proper position on garment 600. Similarly, if button 600 has completely separated from garment 600, it is replaced in the desired location on garment 600. In this embodiment with button 500 in place, wire 20 is positioned so that first end 22 aligns with one of the thread receiving holes 502, and second end 24 aligns with another of the thread receiving holes 502 (also refer to FIG. 10). In another embodiment, first 22 and second 24 ends of wire 20 can first be inserted into holes 502 of button 500, and wire 20 effectively used as a handle to place button 500 in a desired location on garment 600.

Figure 10:
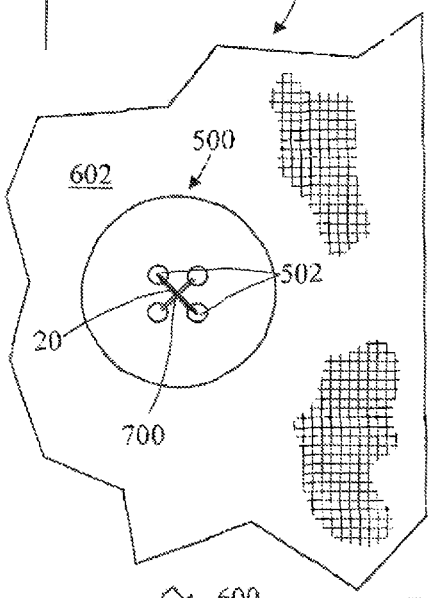
FIG. 10 is a fragmented front elevation view of the wire pushed through the button and the garment.
Figure 11:
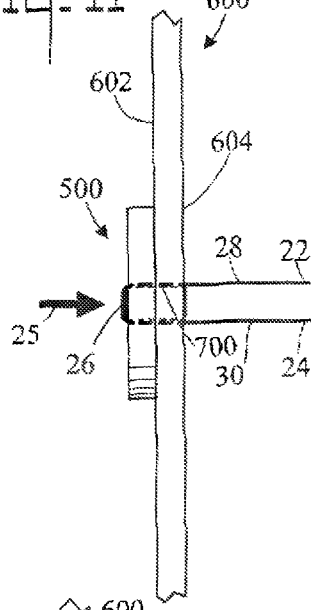
FIG. 11 is a fragmented side elevation view of the wire pushed through the button and garment.

FIGS. 10 and 11 are fragmented front elevation and side elevation views, respectively, of wire 20 pushed through button 500 and garment 600. First 22 and second 24 ends of wire 500 are manually inserted into thread receiving holes 502. Wire 20 is then manually pushed in direction 25 through garment 600 from front side 602 to back side 604 so that wire 20 (cross member 26 in the shown embodiment) urges button 500 into contact with first side 602 of garment 600. First 22 and second 24 ends penetrate back side 602 of garment 600 thereby forming first 28 and second 30 protruding respectively. In the shown embodiment, thread 700 is disposed in thread receiving holes 502. The insertion of wire 20 takes place without removing thread 700 from thread receiving holes 502. In other words, wire 20 pushes past thread 700.

Figure 12:
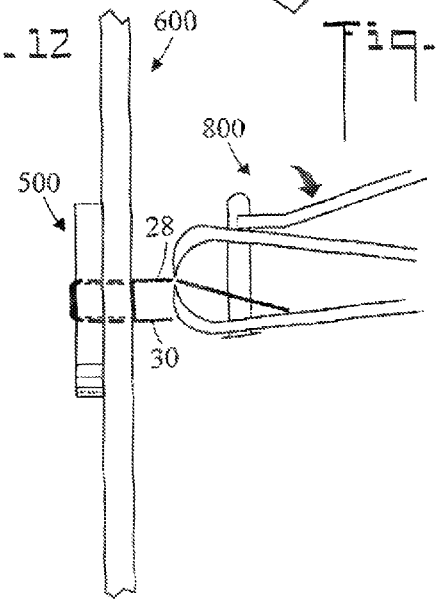
FIG. 12 is a fragmented side elevation view of protruding legs cut off to a desired length.

FIG. 12 is a fragmented side elevation view of protruding legs 28 and 30 cut off to a desired length. The cutting process can be implemented with nail clippers 800 shown in fragment view. The length of protruding legs 28 and 30 after cutting is sufficient to bend over and hold button 500 in place on garment 600.

Figure 13:
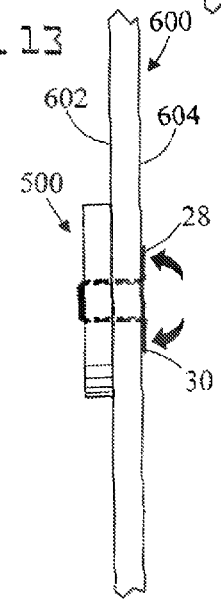
FIG. 13 is a fragmented side elevation view of the protruding legs bent over to abut the back side of the garment in accordance with the present invention.

FIG. 13 is a fragmented side elevation view of protruding legs 28 and 30 bent over to abut back side 604 of garment 600. By bending protruding legs 28 and 30 approximately 90°, button 500 is locked in close contact with front side 602 of garment 600. In the shown embodiment, first 28 and second 30 protruding legs are bent over in opposite directions (i.e. substantially 180° apart).

Figure 14:
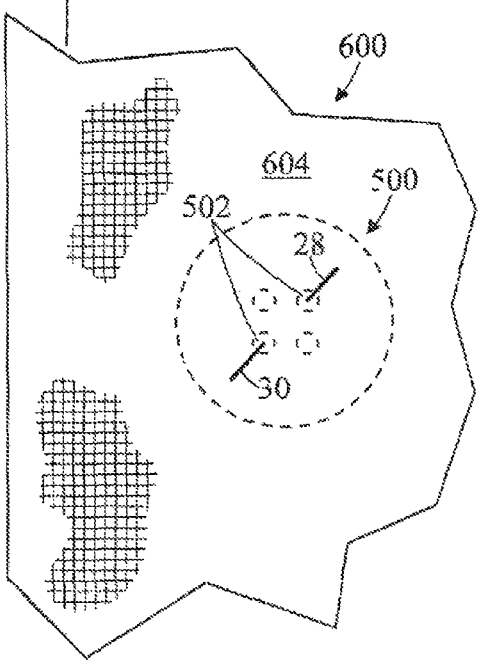
FIG. 14 is a fragmented rear elevation view showing the back side of the garment with the bent over protruding legs.

FIG. 14 is a fragmented rear elevation view showing button 500, thread receiving holes 502, back side 604 of garment 600 with bent over protruding legs 28 and 30.

Figure 15:
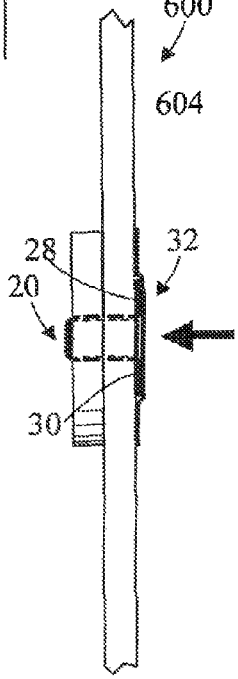
FIG. 15 is a fragmented side elevation view showing a sheet covering the bent over protruding legs.
Figure 16:
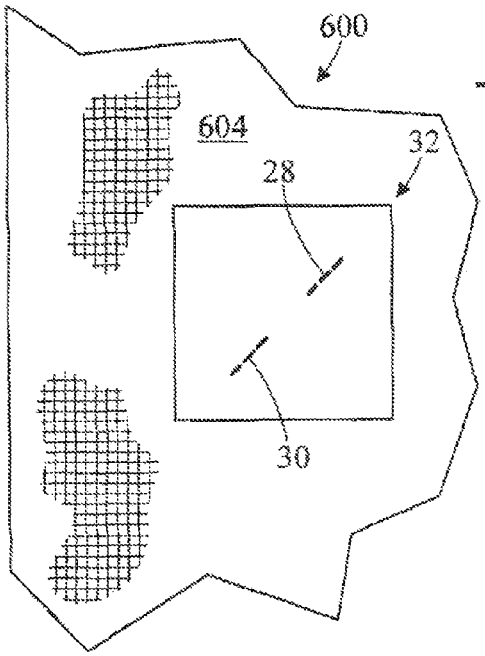
FIG. 16 is a fragmented rear elevation view showing the sheet covering the bent over protruding legs.

FIGS. 15 and 16 are fragmented side elevation and fragmented rear elevation views, respectively, showing a sheet 32 (such as of fabric) covering the bent over protruding legs 28 and 30. Sheet 32 is shaped and dimensioned to be adhesively applied to back side 604 of garment 600 and cover bent over first 28 and second 30 protruding legs. Sheet 32 has been adhesively applied, to back side 604 of garment 600 so that sheet 32 covers bent over first 28 and second 30 protruding legs.

Figure 17:
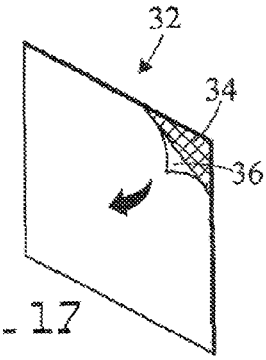
FIG. 17 is a perspective view of the sheet having an adhesive coating with a peel off cover.

FIG. 17 is a perspective view of sheet 32 that has a self sticking adhesive coating 34 with a peel off protective cover 36.

Figure 18:
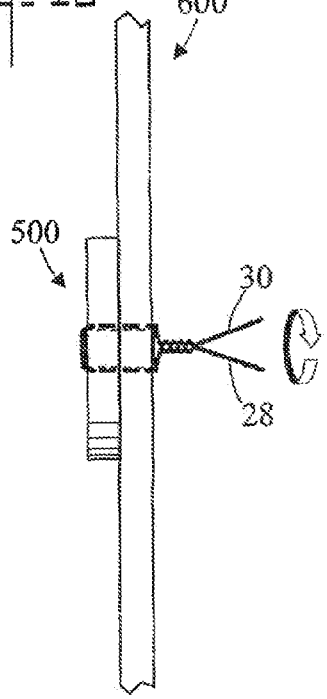
FIG. 18 is a fragmented side elevation view as in FIG. 11 with the protruding legs being twisted together.

FIG. 18 is a fragmented side elevation view as in FIG. 1 with protruding leas 28 and 30 being twisted together. In this embodiment, first 28 and second 30 protruding legs are manually twisted together, thereby locking button 500 to garment 600.

Figure 19:
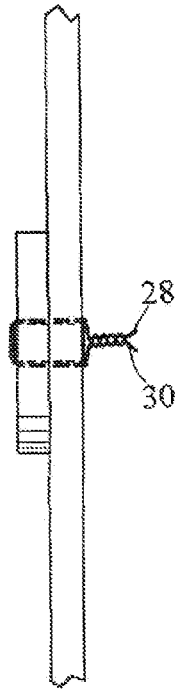
FIG. 19 is a fragmented side elevation view showing the twisted protruding legs being cut off to a desired length.

FIG. 19 is a fragmented side elevation view showing the twisted protruding legs 28 and 30 being cut off to a desired length.

Figure 20:
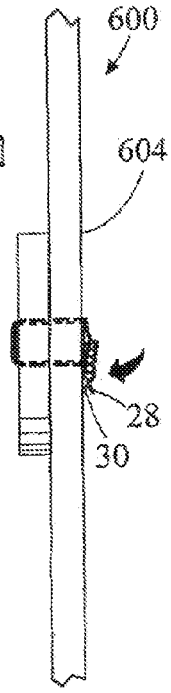
FIG. 20 is a fragmented side elevation view of the cut off twisted protruding legs being bent over to abut the back side of the garment.

FIG. 20 is a fragmented side elevation view of the cut off twisted protruding legs 28 and 30 being bent over to abut back side 604 of garment 600.

Figure 21:
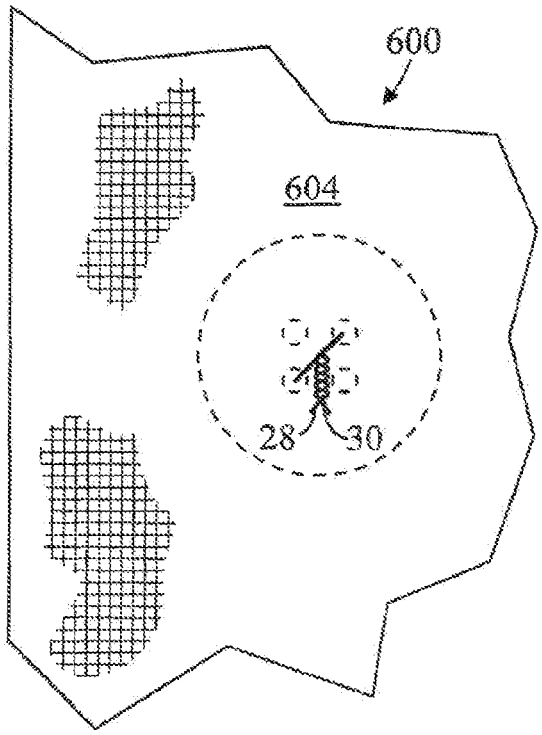
FIG. 21 is a fragmented rear elevation view showing the back side of the garment with the bent over and twisted protruding legs; and, FIG. 22 is a fragmented rear elevation view showing the sheet applied to the back side of the garment so as to cover the bent over and twisted protruding legs.

FIG. 21 is a fragmented rear elevation view showing back side 604 of garment 600 with the bent over and twisted protruding legs 28 and 30 abutting back side 604 of garment 600.

Figure 22:
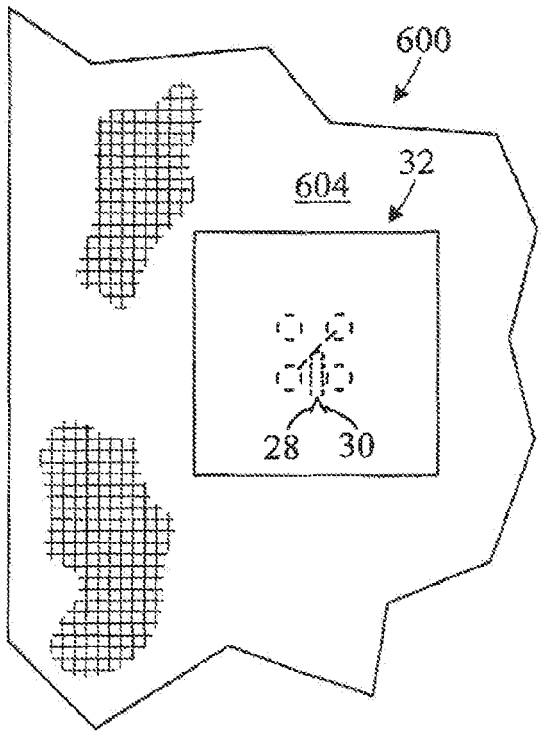

FIG. 22 is a fragmented rear elevation view showing sheet 32 applied to the back side 604 of garment 600 so as to cover bent over and twisted protruding legs 28 and 30. Sheet 32 is shaped and dimensioned to be adhesively applied to back side 604 of garment 600 and cover twisted and bent over first 28 and second 30 protruding legs.

In terms of use, a method for reconnecting a button 500 to a garment 600 includes (refer to FIGS. 1-21):

(a) providing a garment 600 having a front side 602 and an opposite back side 604;

(b) providing a button 500 that has come loose from front side 602 of garment 600, button 500 having a plurality of thread receiving holes 502, thread receiving holes 502 having a diameter D;

(c) providing a wire 20 having a first end 22, a second end 24, and a wire thickness T that is less than diameter D of thread receiving holes 502 of button 500, wire 20 having a stiffness k that both (1) permits wire 20 to be manually pushed through garment 600 from front side 602 to back side 604, and (2) permits wire 20 to be manually bent over so that it abuts back side 604 of garment 600;

(d) positioning button 500 in a desired location on front side 602 of garment 600;

(e) manually inserting first 22 and second 24 ends of wire 20 into thread receiving holes 502 and pushing wire 20 through garment 600 from front side 602 to back side 604 so that wire 20 urges button 500 into contact with first side 602 of garment 600, and first end 22 and second end 24 penetrate back side 604 of garment 600 thereby forming first 28 and second 30 protruding legs respectively; and, (f) manually bending over first 28 and second 30 protruding legs until they abut back side 604 of garment 600.

The method further including:

(g) providing a sheet 32 that is shaped and dimensioned to be adhesively applied to back side 604 of garment 600 and cover bent over first 28 and second 30 protruding legs; and, (h) adhesively applying sheet 32 to back side 604 of garment 600 so that sheet 32 covers bent over first 28 and second 30 protruding legs.

The method further including:

in (f), first 28 and second 30 protruding legs being bent over in opposite directions.

The method further including:

after (e) and before (f), cutting off first 28 and second 30 protruding legs to a desired length.

The method further including:

in (c), first 22 and second 24 ends of wire 20 being sharpened to facilitate passage through garment 600 in (e).

The method further including:

in (c), wire 20 preformed into an elongated U-shape.

The method further including:

in (b), two of thread receiving holes 502 being spaced apart a distance L;

in (c), wire 20 having two elongated substantially parallel segments; and, in (c), the segments being spaced apart a distance L1 that is substantially equal to spaced apart distance L thread receiving holes 502.

The method further including:

in (c), wire 20 fabricated from aluminum.

The method further including:

prior to (e), thread 700 disposed in thread receiving holes 502; and, in (e), the inserting taking place without removing thread 700 from thread receiving holes 502.

The method further including:

manually twisting first 28 and second 30 protruding legs together, and then bending over the twisted first 28 and second 30 protruding legs until they abut back side 604 of garment 600.

The embodiments of the method and apparatus described herein are exemplary and numerous modifications, combinations, variations, and rearrangements can be readily envisioned to achieve an equivalent result, all of that are intended to be embraced within the scope of the appended claims. Further, nothing in the above-provided discussions of the method and apparatus should be construed as limiting the invention to a particular embodiment or combination of embodiments. The scope of the invention is best defined by the appended claims.

I claim:

1. A method for reconnecting a button to a garment, comprising:

(a) providing a garment having a front side and an opposite back side;

(b) providing a button that has come loose from said front side of said garment, said button having a plurality of thread receiving holes, said thread receiving holes having a diameter;

(c) providing a wire having a first end, a second end, and a wire thickness that is less than said diameter of said thread receiving holes of said button, said wire having a stiffness that both (1) permits said wire to be manually pushed through said garment from said front side to said back side, and (2) permits said wire to be manually bent over so that it abuts said back side of said garment;

(d) positioning said button having thread disposed in said thread receiving holes in a desired location on said front side of said garment;

(e) manually inserting said first and second ends of said wire into said thread receiving holes without removing said thread from said thread receiving holes and pushing said wire through said garment from said front side to said back side so that said wire urges said button into contact with said first side of said garment, and said first end and said second end penetrate said back side of said garment thereby forming first and second protruding legs respectively; and, (f) manually bending over said first and second protruding legs until they abut said back side of said garment.

2. The method of claim 1, further including:

(g) providing a sheet that is shaped and dimensioned to be adhesively applied to said back side of said garment and cover said bent over first and second protruding legs; and, (h) adhesively applying said sheet to said back side of said garment so that said sheet covers said bent over first and second protruding legs.

3. The method of claim 1, further including:

in (f), said first and second protruding legs being bent over in opposite directions.

4. The method of claim 1, further including:

after (e) and before (f), cutting off said first and second protruding legs to a desired length.

5. The method of claim 1, further including:

in (c), said first and second ends of said wire being sharpened to facilitate passage through said garment in (e).

6. The method of claim 1, further including:

in (c), said wire preformed into an elongated U-shape.

7. The method of claim 6, further including:

in (b), two of said thread receiving holes being spaced apart a distance L;

in (c), said wire having two elongated substantially parallel segments; and, in (c), said segments being spaced apart a distance L1 that is substantially equal to the spaced apart distance L of said two thread receiving holes.

8. The method of claim 1, further including:

in (c), said wire fabricated from aluminum.

9. A method for reconnecting a button to a garment, comprising:

(a) providing a garment having a front side and an opposite back side;

(b) providing a button that has come loose from said front side of said garment, said button having a plurality of thread receiving holes, said thread receiving holes having a diameter;

(c) providing a wire having a first end, a second end, and a wire thickness that is less than said diameter of said thread receiving holes of said button, said wire having a stiffness that both (1) permits said wire to be manually pushed through said garment from said front side to said back side, and (2) permits said wire to be manually bent over so that it abuts said back side of said garment;

(d) positioning said button having thread disposed in said thread receiving holes in a desired location on said front side of said garment;

(e) manually inserting said first and second ends of said wire into said thread receiving holes without removing said thread from said thread receiving holes and pushing said wire through said garment from said front side to said back side so that said wire urges said button into contact with said first side of said garment, and said first end and said second end penetrate said back side of said garment thereby forming first and second protruding legs respectively;

(f) manually twisting said first and second protruding legs together; and, (g) bending over said twisted first and second legs until they abut said back side of said garment.

10. The method of claim 9, further including:

(h) providing a sheet that is shaped and dimensioned to be adhesively applied to said back side of said garment and cover said twisted and bent over first and second protruding legs; and, (i) adhesively applying said sheet to said back side of said garment so that said sheet covers said twisted and bent over first and second protruding legs of said wire.

11. The method of claim 9, further including:

after (e) and before (g), cutting off said first and second protruding legs to a desired length.

12. The method of claim 9, further including:

in (c), said first and second ends of said wire being sharpened to facilitate passage through said garment in (e).

13. The method of claim 9, further including:

in (c), said wire preformed into an elongated U-shape.

14. The method of claim 13 further including:

in (b), two of said thread receiving holes being spaced apart a distance L;

in (c), said wire having two elongated substantially parallel segments; and in (c), said segments being spaced apart a distance L1 that is substantially equal to the spaced apart distance L of said two thread receiving holes.

15. The method of claim 9, further including:

in (c), said wire fabricated from aluminum.

16. An apparatus for reconnecting a button having a plurality of thread receiving holes, the thread receiving holes having a diameter, to a garment having a front side and an opposite back side, the button having come loose from said front side of said garment, comprising:

a wire having a first end, a second end, and a wire thickness that is less than the diameter of the thread receiving holes of the button;

said wire having a stiffness that both (1) permits said wire to be manually pushed through the garment from the front side to the back side, and (2) permits said wire to be manually bent over so that it abuts the back side of the garment; and, a sheet that is shaped and dimensioned to be adhesively applied to the back side of the garment and cover said wire after said wire is pushed through the garment and bent over.

17. The apparatus according to claim 16, further including:

said first and second ends of said wire being sharpened to facilitate passage through the garment.

18. The apparatus according to claim 16, further including:

said wire preformed into an elongated U-shape.

19. The apparatus according to claim 16, where two of the thread receiving holes are spaced apart a distance L, further including:

said wire having two elongated substantially parallel segments; and, said segments being spaced apart a distance L1 that is substantially equal to the spaced apart distance L of the two thread receiving holes.

20. The apparatus according to claim 16, further including:

said wire fabricated from aluminum.

* * * * *